United States Patent [19]

Lide, Jr.

[11] 3,949,885

[45] Apr. 13, 1976

[54] CARRIER LOADING DEVICE

[75] Inventor: Theodore E. Lide, Jr., Madison, N.C.

[73] Assignee: Burlington Industries, Inc., Greensboro, N.C.

[22] Filed: Jan. 17, 1975

[21] Appl. No.: 542,004

[52] U.S. Cl. ..... 214/1 B; 214/DIG. 3

[51] Int. Cl.[2] ..... B25J 3/00

[58] Field of Search..... 214/1 B, 1 BC, 1 Q, DIG. 1, 214/DIG. 3, 8, 6 C; 57/131, 132

[56] References Cited

UNITED STATES PATENTS

| | | | |
|---|---|---|---|
| 3,240,356 | 3/1966 | Hill | 214/8 |
| 3,434,602 | 3/1969 | Vann | 214/1 Q |
| 3,441,148 | 4/1969 | Pim | 214/1 Q |

*Primary Examiner*—Philip Goodman
*Assistant Examiner*—John A. Carroll
*Attorney, Agent, or Firm*—Cushman, Darby & Cushman

[57] ABSTRACT

A loading and unloading device for yarn package carriers. A tiltable device for supporting a package carrier may be moved so that a carrier supported thereby is disposed horizontally. Loading of the carrier with yarn packages while the spindles are in the horizontal position is accomplished by tray means having powered means associated therewith for moving the packages from the tray means onto a selected spindle, and compressing of the packages thereon. The carrier may be rotated, and the tray means reciprocated to position each spindle in turn in operative relationship with the tray means. After loading, the carrier is returned to vertical, unlocked from the tiltable device, and removed for dyeing. After dyeing, the carrier may be placed on the device again, and tilted to remove the packages therefrom.

16 Claims, 8 Drawing Figures

60
72
74
73
14
70
68
66
69
67
102
80
78
75
64
62
95
96
97
99
98
76
61

CARRIER LOADING DEVICE

BACKGROUND AND SUMMARY OF THE INVENTION

The invention relates to the loading and unloading of yarn package carriers with yarn packages for dyeing in standard dye machines. Heretofore, the loading of package carriers has been accomplished only in a vertical direction with packages initially dropped vertically from the top onto each spindle until the spindle was full, at which time a pole serving as a spindle extension was attached to the spindle with several more packages being slid down over this extension. Thereafter, a vertical compressor device compressed the stack of packages to a point where the top of the last package was below the top of the spindle, the spindle extension was removed and a retainer was placed on the end of the spindle to secure the packages in the compressed condition prior to the withdrawal of the vertical compressor. This process has been relatively time consuming and labor intensive, requiring the placing and removing of the spindle extension and manual dropping of each yarn package, damage to the yarn packages has been frequent due to the long drops involved, and a production area having a relatively high ceiling has been necessary because of the necessity of using the spindle extension and a vertically oriented compressing means placed thereon. Also, a number of safety problems have been associated with vertical loaders. Examples of prior art devices are disclosed in U.S. Pat. 3,768,680, and German Offenlegungsschrift No. 2,300,838.

According to the teachings of the present invention, a horizontally disposed semi-automatic yarn package carrier loading assembly and a method of loading such a carrier are disclosed which eliminate the above mentioned disadvantages. A frame is provided for supporting a yarn package carrier to be loaded. The frame in one position thereof is oriented so that a carrier attached thereto has the spindles thereof disposed vertically, and the frame is tiltable from that position to a yarn package loading position thereof wherein the spindles are disposed horizontally. A powered indexing device associated with the tiltable frame rotates the carrier so that the spindles thereof are sequentially brought into an operative position for loading.

For loading a spindle of the yarn package carrier when it is disposed in an operative horizontal position there is provided a loading device. The loading device comprises a pair of semicircular horizontally disposed trays, one of the trays being pivotal about an axis between the trays to deposit yarn packages from that tray to the other tray. A horizontally reciprocal compressor is disposed within the other semicicular tray to move yarn packages retained in the tray onto the spindle in operative relationship therewith, and to compress the yarn packages onto the spindle. Since the elements are all horizontally disposed, no dropping of yarn packages is necessary, the ceiling of the production area need not be high, no spindle extension is necessary, the speed of loading packages is greatly increased and there are no significant safety problems. Semi-automatic means are provided for moving the loading device into proper alignment with the semi-auotmatically tiltable carrier frame, which means allow for proper alignment of parts before compressing of the yarn on the spindles.

It is a principal object of this invention to provide an improved apparatus and method for loading yarn packages on spindles of a yarn package carrier so that a spindle extension is not necessary, damage to yarn packages is reduced, the requirements of space for production activities are reduced, there are no significant safety problems, and the time for loading a carrier is reduced. This and other objects of the invention will become clear from an inspection of the detailed description of the invention and the appended claims.

DETAILED DESCRIPTION OF THE INVENTION

Figure 1:
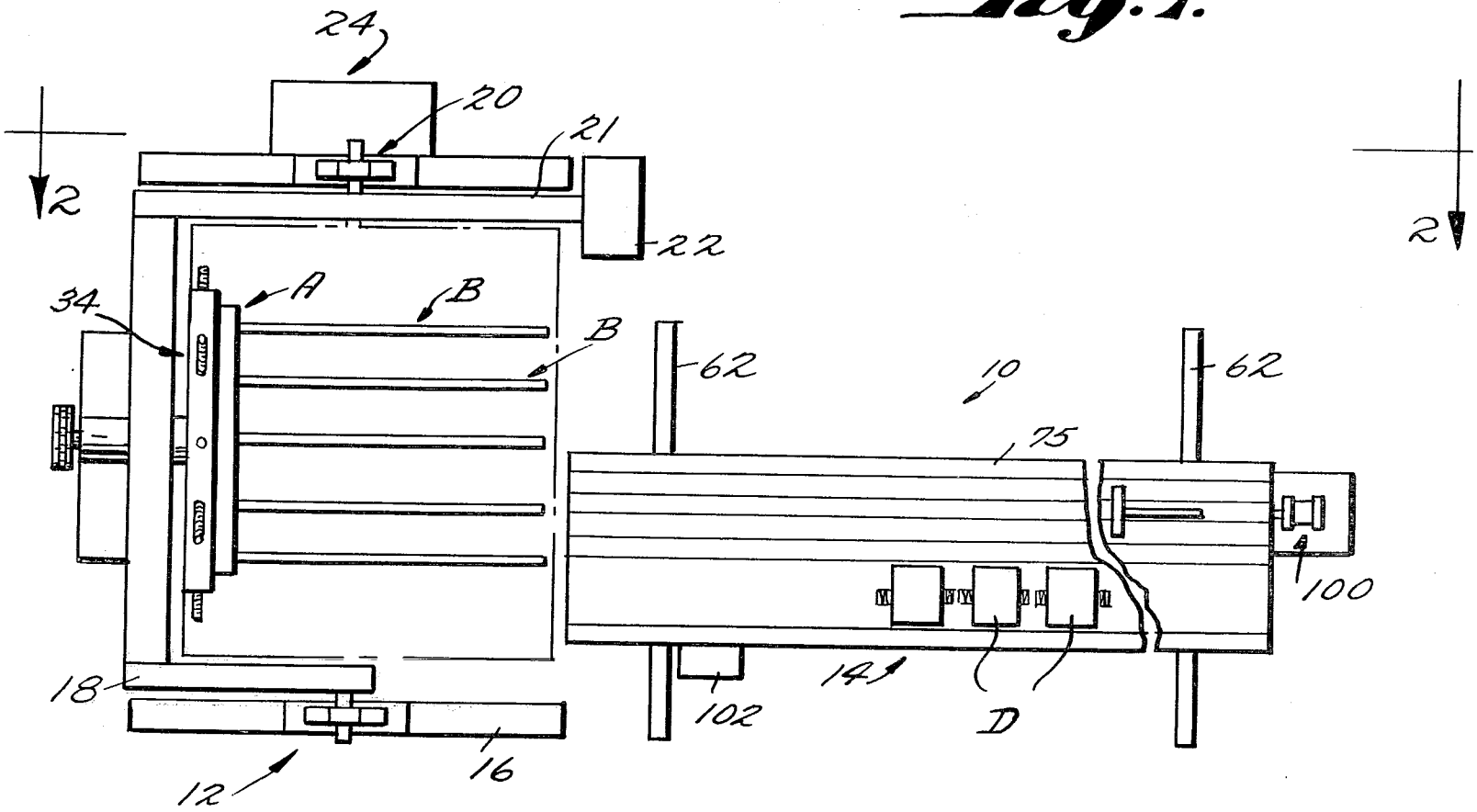
FIG. 1 is a top plan view of exemplary apparatus according to the teachings of the present invention showing the tiltable frame and carrier thereon in its horizontal position for spindle loading, with some of the spindles cut away for clarity.

Exemplary apparatus according to the present invention is shown generally at 10 in FIG. 1. The apparatus includes two main components, carrier tilting assembly 12, and loader assembly 14. The carrier tilting assembly 12 comprises a stationary frame component 16, and a pivotal frame component 18 which is pivotally mounted via any suitable means, such as pins 20, for pivotal movement with respect to the stationary component 16. A weight 22 may be mounted on an arm 21 of member 18 to balance the weight of a loaded package carrier A when the member 18 is in a horizontal position.

A power means, such as electric motor 24 or the like, may be provided to pivot the member 18 with respect to the member 16. The motor may be mounted on either side of frame 18 (compare FIGS. 1 and 2) but it is preferred that it be mounted as shown in FIG. 1, opposite the side that the operator normally would stand. Frame component 18 may be pivoted from the position shown in FIG. 3*a*, the spindles B of a package carrier thereon being initially in a vertical position, to the horizontal spindle position shown in FIG. 1 for loading. Suitable means for rotating the frame 18 in response to actuation of the motor 24 may be a sprocket 28 connected to a pin 20, or any other suitable means. A safety rod 30 or the like or an electrically operated brake may be used to prevent pivoting of the component 18 relative to the component 16 when the component 18 is in the position shown in FIG. 2.

Figure 3A:
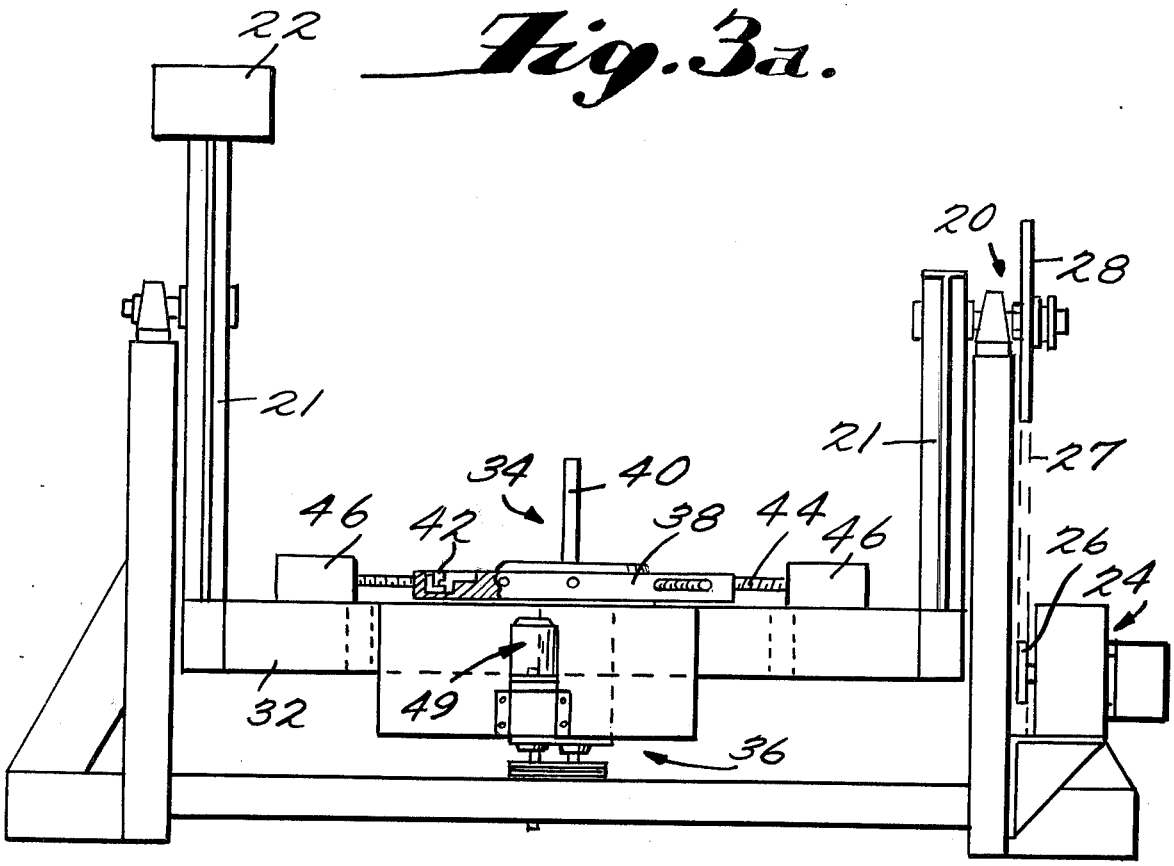
FIG. 3*a* is a frontal view of the tiltable frame shown in FIG. 1 with the yarn package carrier removed.
Figure 3C:
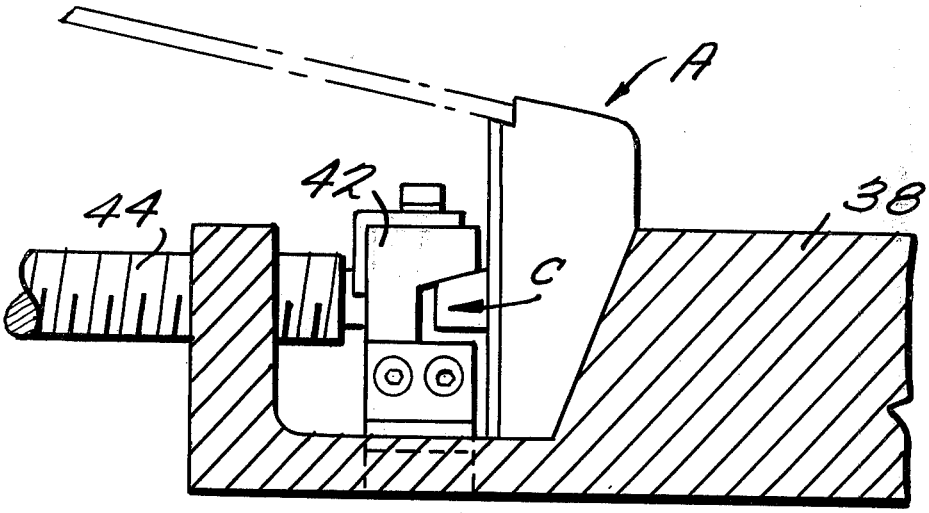
FIG. 3*c* is a detail view of an individual component of the holding means shown in FIG. 3*b;*
Figure 3B:
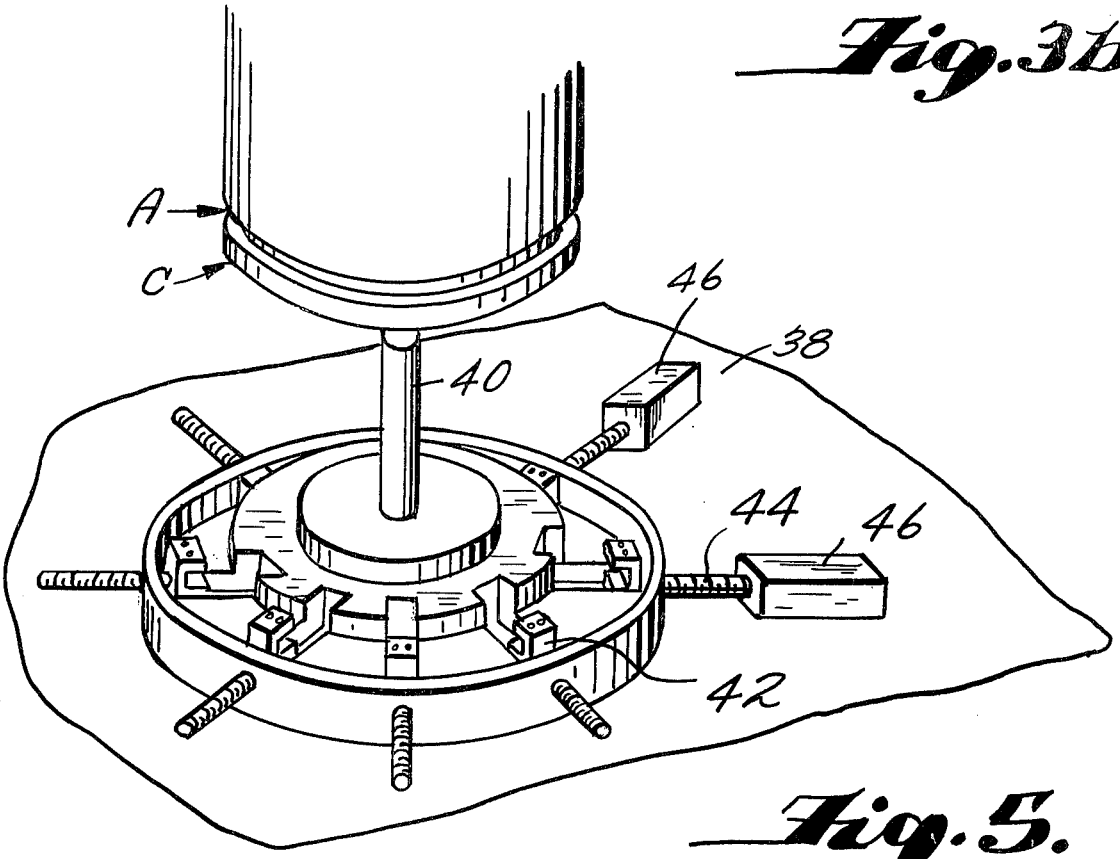
FIG. 3*b* is a detail top plan view of exemplary holding means for the package carrier associated with the tiltable frame.

Mounted on cross-member 32 between arms 21 of member 18 is a package carrier receiving and locking assembly, shown generally at 34 in FIGS. 3*a* and 3*b*. A power means 36 or the like may be provided for rotating the assembly 34 with respect to the member 32. The assembly 34 includes a plate member 38 contoured to receive a carrier A and an upstanding rod 40 from plate 38 for assisting in locating a carrier A with respect to the plate 38 when the carrier is being lowered thereon. A plurality of locking projections 42 driven by screw-threaded rode 44 or the like are mounted on plate 38 and are relatively movable with respect thereto to engage locking projections C on a carrier A. Power means such as motors 46 may be provided for rotating the rods 44 to move the projections 42 into proper engagement with the projections C. A connection is provided between each of the portions 42 and 44 that allows the portion 42 to move longitudinally without rotating while the rod 44 rotates.

Figure 2:
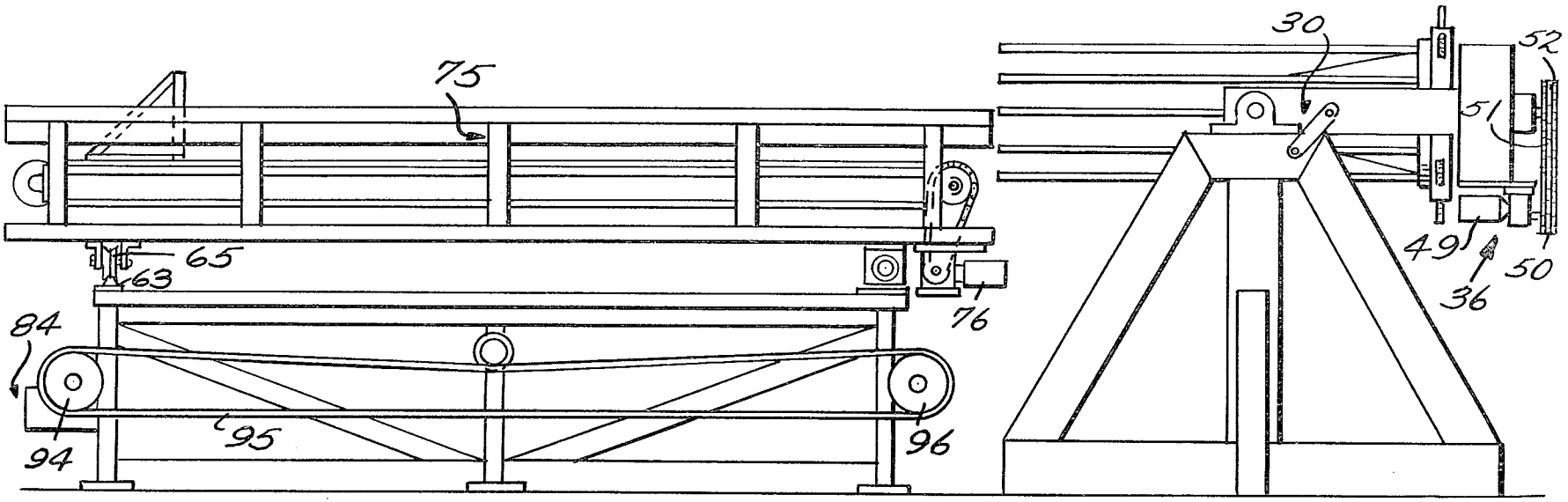
FIG. 2 is a side view of the apparatus of FIG. 1 taken along lines 2—2 of FIG. 1.

The power means 36 for rotating the assembly 34 relative to the member 32 may include an electric motor 49 mounted on member 32 which drives a sprocket 50 connected by a chain 51 to a sprocket 52 which is operatively connected to the assembly 34 [see FIG. 2].

Figure 4:
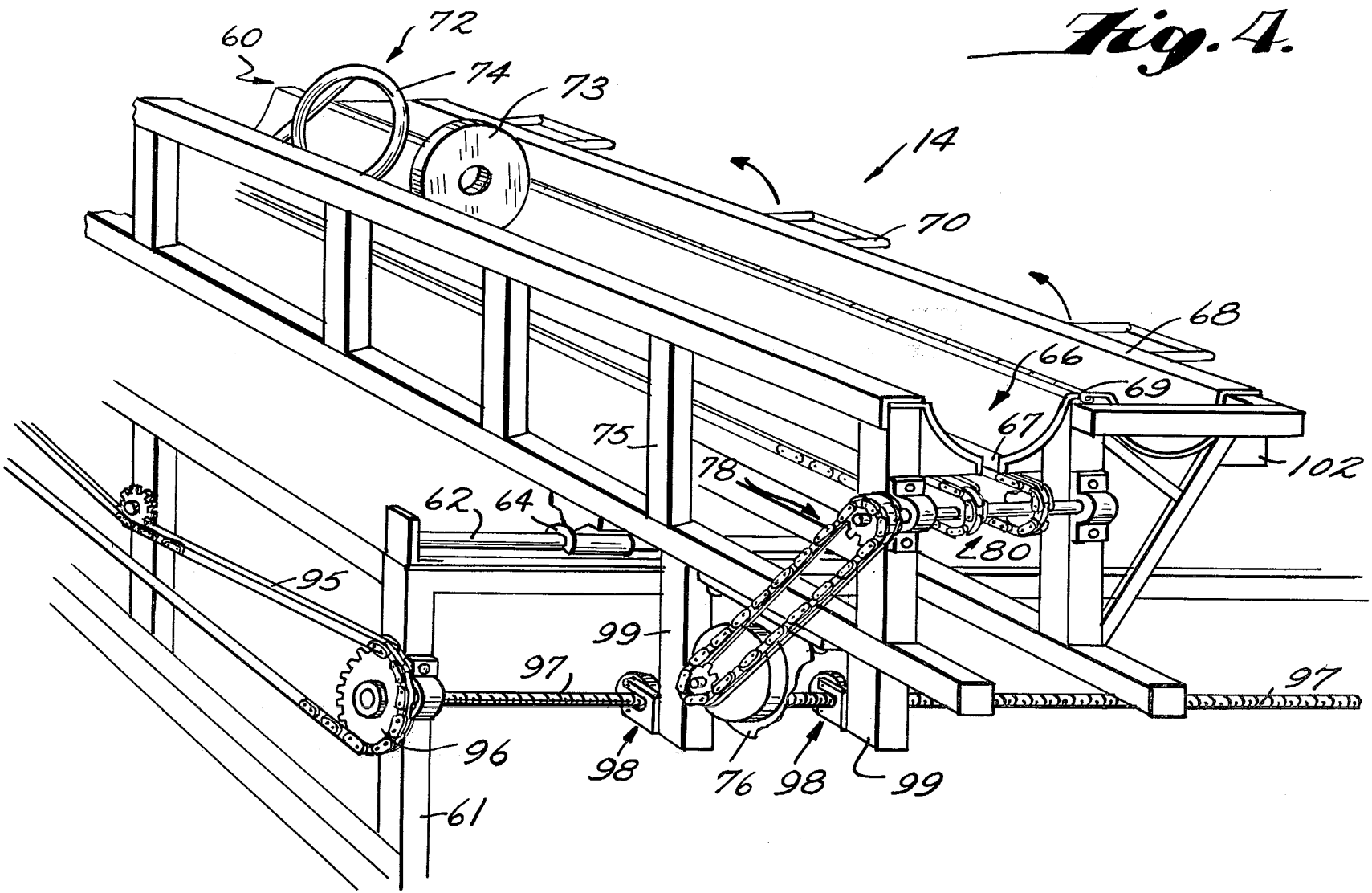
FIG. 4 is a frontal perspective view of the loading device pictured in FIG. 1.

Referring to FIGS. 1, 2 and 4, the loading assembly 14 for loading yarn packages D onto the spindles B of a carrier A mounted on assembly 12 includes a tray means, shown generally at 60, mounted on a frame 75, which frame is supported by a stationary frame 61 and guide tracks 62 and 63 thereon. The guide tracks 62 and 63 comprise elongated members that are disposed in a horizontal plane and are generally perpendicular to an extension of the spindles B when in the position shown in FIG. 1. Guide sleeves 64 may cooperate with track 62 while rollers 65 cooperate with track 63 to define the longitudinal movement of the means 60 [and frame 75].

The tray means 60 for receipt of yarn packages D includes a generally semi-circular tray 66 having a slot 67 therein, and a cooperating generally semi-circular tray 68 that is pivotal (as about pivot 69) relative to tray 66. Handles 70 may be provided on tray 68 to facilitate pivotal movement thereof with respect to tray 66 in the direction of the arrow in FIG. 4. Yarn packages D are loaded onto tray 68 and the tray 68 is then pivoted past vertical, thereby transferring the packages D from the tray 68 to the tray 66. Then while the packages D in tray 66 are being loaded onto a spindle B, the tray 68 may be loaded with another set of packages D, so that after one spindle has been loaded, another spindle may be loaded soon thereafter.

A yarn package loading and compressing means 72 is mounted in slot 67 of tray 66 for loading packages D disposed in tray 66 onto a spindle B of a carrier A. The means 72 may include a hoop member 74 which is guided for movement in tray 66 for abutting a plate or disc 73 adjacent the first of a column of yarn packages for moving the packages D and disc 73 out of tray 66 onto a spindle B. A hoop member 74 or the like is preferably provided for the abutting member since access to the interior thereof is possible. Thus when packages D are compressed onto a spindle B it will be easy for an operator to pass a locking nut onto the spindle B through the member 74, the member 74 not interfering therewith.

Any suitable power means may be provided for powering the member 74 to load and compress packages D — such as an electric motor 76 mounted on frame 75 supporting the tray means 60. The motor 76 may drive the member 74 by any suitable connection, such as sprocket and chain assemblies 78 driving sprocket and chain assemblies 80 which are in operative engagement with means 72.

Figure 5:
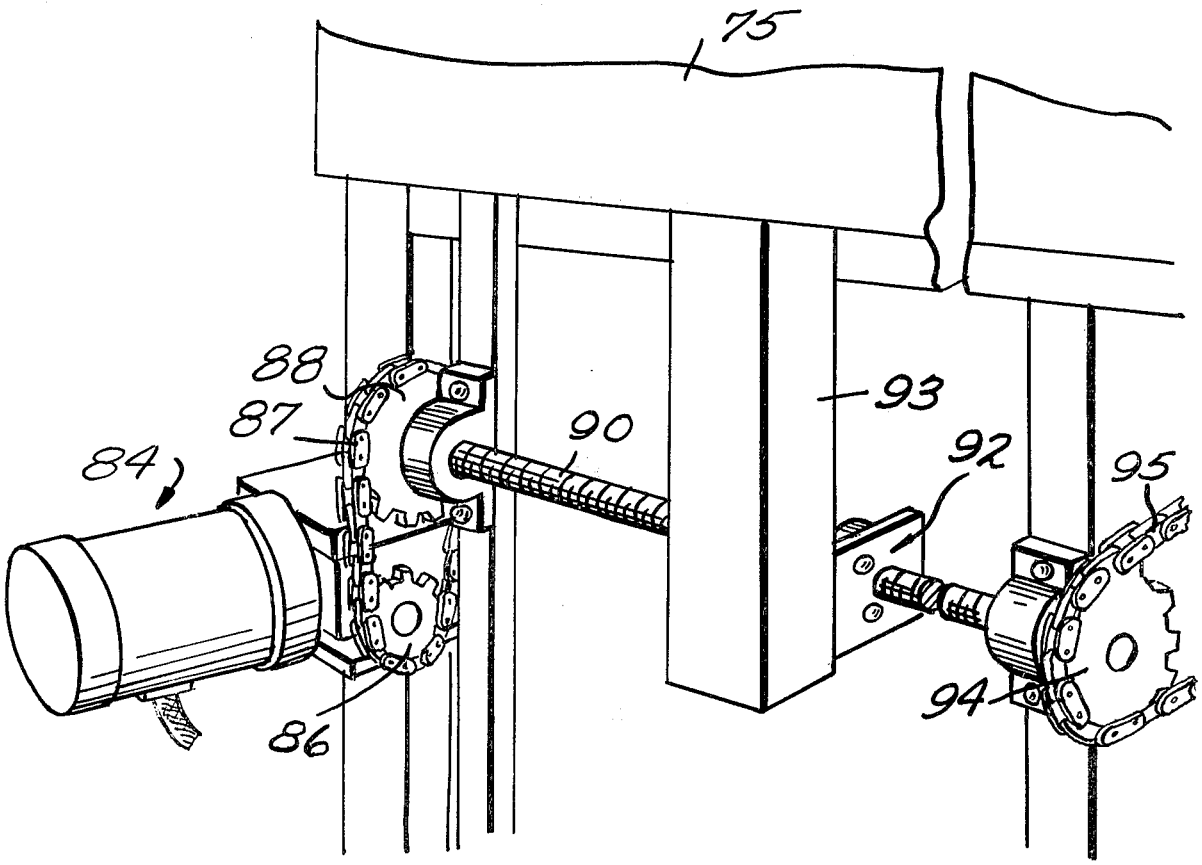
FIG. 5 is a detail perspective view of the drive for the moving of the loading device shown in FIG. 1.

Apparatus for moving the tray means 60 along the tracks 62 and 63 may include any suitable manual or powered means, such as electric motor 84 shown in FIG. 5. The motor 84 may drive the frame 75 of tray means 60 by rotating a screw-threaded rod 90, which rotary movement is transferred to translation of the frame 75 by any suitable connection(s) 92 between extension(s) 93 from frame 75 and the rod 90. A pair of sprockets 86 and 88 interconnected by a chain 87 may be utilized to effect rotation of the rod 90 by motor 84. Since the tray means 60 will usually be quite long, it is desirable that both the rear and front ends of the frame 75 be translated when movement thereof along tracks 62 and 63 is desired. For this reason, the rotation of rod 90 may be keyed to another sprocket 94, which is connected by a chain 95 to another sprocket 96 which in turn drives a screw-threaded rod 97 similar to rod 90, the rotation of rod 97 causing translation of the extensions 99 from frame 75 via suitable connections 98 therebetween.

Since the front portion of tray 66 must be disposed directly adjacent and in line with each spindle B during loading, if carriers A having different length spindles B are to be used it is preferable to provide a means for moving the tray means 60 relative to the frame 75 thereof in a direction parallel to the axes of the spindles B, more specifically toward or away from the end of the spindle in loading position. This may be accomplished by making the tray 66 slidable with respect to the frame 75, and providing a motor 100 or the like mounted to the back of frame 75 for moving the tray 66 relative to the frame 75, and for holding it in a respective position to which it is moved. Also, the motor 100 may be utilized to move the tray 66 within the arc of movement of the spindles B to insure proper transfer of packages D from the tray 66 to the spindle B. The motor 100 will move the tray from that position to a position external to the path of movement of the spindles B before rotation of member A to bring another spindle B into position is effected.

Any suitable controls may be provided for the motors 24, 46, 49, 76, 84 and 100; however, it is most convenient to provide all the controls in a single control box 102 mounted on tray 66 near the front thereof. In this way one operator can correctly position the spindles B and the tray means 60 relative to each other, initiate compression of packages D onto a respective spindle, and place a locking nut onto the end of the spindle B.

Figure 6:
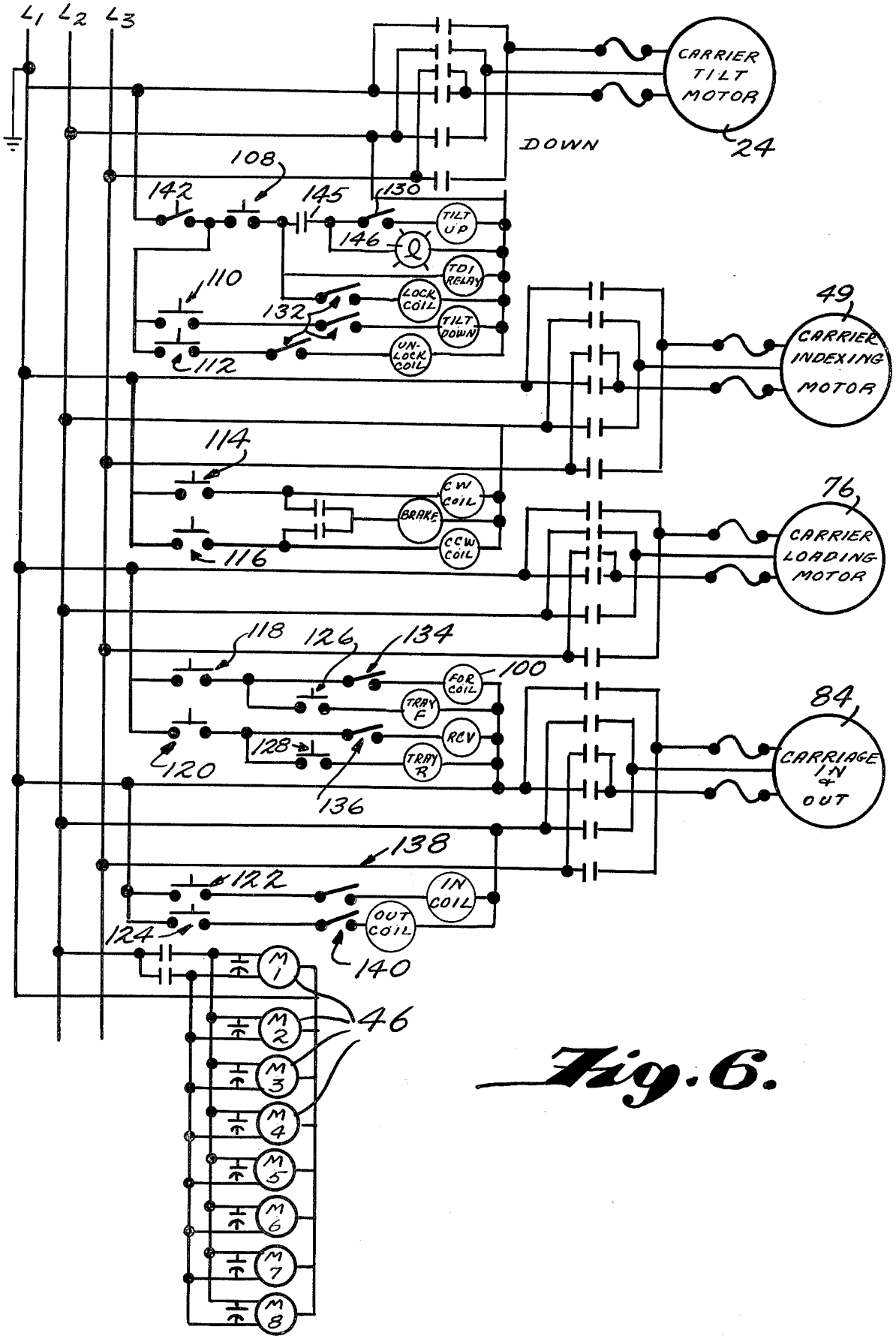
FIG. 6 is a schematic view of exemplary circuitry that may be used with apparatus of the present invention.

FIG. 6 shows exemplary circuitry for controlling the operation of all the motors for operating the apparatus 10. Preferably a plurality of spring-biased open push-button switches 108, 110, 112, 114, 116, 118, 120, 122, 124, 126 and 128 are mounted on control board 102. Switch 108 is for actuating motors 46 for locking a package carrier A onto the plate 38, and for actuating the motor 24 to return the carrier A to its vertical position. Switch 110 is for tilting the carrier to its horizontal position, and switch 112 is for controlling motors 46 to unlock the locking projections 42. A time delay 145 may be provided to prevent unlocking of the projections 46 for a given time after the carrier has been returned to vertical. Switch 114 controls the motor 49 for rotating the carrier A in the clockwise direction, and switch 116 controls motor 49 for rotating the carrier A in the counterclockwise direction. Switches 118 and 120 control the compress and return movement of assembly 72 by controlling motor 76, switches 126 and 128 control the movement of tray 66 relative to frame 75 by controlling motor 100. Switches 122 and 124 control the motor 84 for translating the whole frame 75 on the tracks 62 and 63.

Various limit switches may be provided for limiting the movement of certain members, and for providing an interconnection between one motor actuation and the physical position of another member. For instance limit switch 130 may automatically de-energize motor 24 when the carrier A reaches vertical, limit switches 132 may prevent the actuation of the motors 46 or 24 unless the component 18 is in a certain position, switches 134 and 136 may terminate the reciprocation of the frame 75 by cutting out motor 84, and limit switch 142 may prevent tilting of the member 18 from its horizontal to vertical position unless the tray means 60 is out of interfering relationship therewith.

Other electrical components such as other time delays, indicating means, and interlocks may be provided. For instance an indicator light 146 may be provided to indicate when the locking projection 42 was engaged to prevent damage thereto by an attempt to remove member A while locked to the member 34. Mechanical interlocks may be provided between all of the switches on the panel 102, and electrical interlocks may be provided for preventing actuation of one switch while other components are in a particular position. Also, automatic sensing and control means could optionally be provided for any of the motors, or to correlate indexing and movement thereof. For instance, a proximity sensor(s) may be provided on the front of tray means 60 for sensing the position of a spindle B, whereby upon actuation of motor 49 rotation of the carrier A will take place until a spindle B is in proper orientation with respect to the tray means 60 — or control of both motors 84 and 36 can be coordinated to accomplish this after sensing. Also, loading motor 76 may have one speed for compression (a relatively slow speed to insure that the yarn packages D are not damaged), and another speed for return (a relatively fast speed to save time on loading).

Exemplary apparatus according to the invention having been described, a typical method of operation thereof will now be set forth. An empty carrier A is placed on plate 38 and rod 40 of member 18 while member 18 is in its vertical position, and motors 46 are energized, locking portions C of carrier A with projections 42. Motor 24 is then actuated, tilting the yarn package carrier A into a position wherein the spindles B thereon are horizontally disposed (see FIG. 1). Motor 84 is then actuated to translate tray means 60 into operative location with respect to a spindle B of carrier A, motor 49 is actuated if necessary to position a spindle B in exact alignment with tray 66, and motor 100 may be actuated to move the tray means 66 into the arc of movement of the spindles B.

Tray 68 having been loaded with yarn packages D, it is now pivoted past vertical with the result that the packages therefrom are deposited in tray 66. Compression disc 73 is placed between the last yarn package D and the hoop 74 to insure that compression forces are applied evenly to the end of the yarn packages, and to provide a backing for a locking nut to be screwed onto a spindle B once the packages D are compressed thereon. Then motor 76 is actuated, causing member 74 to move the packages D from the tray 66 onto a spindle B, and to compress them onto the spindle B (the normal length of the column of packages D to be loaded being greater than the length of a spindle B). When they are properly compressed, the operator inserts a locking nut through hoop 74 onto the top of spindle B (abutting the backing plate 73), thereby fixing the compressed packages onto the spindle B. Motor 76 is again actuated, withdrawing the member 74 from the spindle B, the assembly is moved out of the path of movement of spindles B by motor 100, the motors 84 and 49 are actuated to again position a spindle B which is not loaded into operative relationship with tray 66, packages D from tray 68 (which have been loaded during the compression of the previous packages onto the previous spindle) are deposited in tray 66, and motor 76 is again actuated to compress the packages onto the new spindle. Normally the carrier A is rotated by motor 49 in the counterclockwise direction, and spindles B in the interior of the carrier A are loaded first, so that a loaded spindle will not normally be disposed above a spindle that is being loaded. This is because the weight of the yarn packages is often great enough to cause the spindle to deflect downwardly and interfere with the loading of the spindle thereunderneath.

After loading of the whole carrier A, the tray means 60 is returned to its original position, out of interfering relationship with the spindles B when they are tilted, the spindles are tilted back to their vertical position by the actuation or motor 24, the locking means 42 are unlocked by actuation of motors 46, and the carrier A may be removed from the assembly 12. This operation may be repeated as desired. After the loaded packages are dyed, the carrier may again be placed on the assembly 12, the locking nuts on the spindles removed, and the carrier may be tilted below the horizontal and away from the loader assembly 14 to let the packages slide off into a basket or the like.

It will thus be seen that an improved method and apparatus have been disclosed for loading of dye carriers with yarn packages, whereby the use of a spindle extension is not necessary, damage to yarn packages is reduced, the requirements of space for production activities are reduced, there are no significant safety problems, and the time for carrier loading is reduced. While the invention has been herein shown and described in what is presently conceived to be the most practical and preferred embodiment, it will be obvious to those of ordinary skill in the art that many modifications may be made thereof within the scope of the invention. For instance, other means for tilting the carrier, rotating the carrier, moving or guiding the loading means, compressing the yarn packages, controlling motor actuation and synchronization, and positioning yarn packages for loading may be provided. Thus it is intended that the appended claims be given their broadest interpretation so as to encompass all equivalent structures and methods.

What is claimed is:

1. An assembly for loading a plurality of yarn packages onto spindles of a yarn package carrier without the necessity of using a spindle extension, said assembly comprising:

a. a first frame for supporting a yarn package carrier, b. means for holding a yarn package carrier onto said first frame, said holding means and a carrier mounted thereon being rotatable about an axis of rotation with respect to said first frame for proper alignment of a spindle of a carrier with yarn packages to be loaded, c. means for mounting said first frame for tilting movement with respect to a stationary second frame so that said first frame is movable from a first generally vertical position to a second generally horizontal position, d. generally horizontally disposed loading tray means for receipt of a plurality of yarn packages for subsequent disposition on a spindle of a yarn package carrier, e. means for supporting said tray means for movement with respect to a horizontally disposed spindle of a yarn package carrier mounted on said first frame so that yarn packages on said tray means may be moved onto said spindle, and f. means associated with said tray means for moving yarn packages from said tray means onto a horizontally disposed spindle of a yarn package carrier mounted on said first frame, and for compressing said packages onto said spindle.

2. An assembly as recited in claim 1 further comprising means for moving said first frame from its first position thereof to its second generally horizontal position thereof.

3. An assembly as recited in claim 1 wherein said generally horizontally disposed tray means comprise a first tray receiving said package moving and compressing means therein, and a pivotally mounted second tray, said second tray being pivotal from a position wherein an open face of said second tray is parallel to said first tray and said second tray is horizontally disposed but spaced from said first tray through 180°, to a position wherein said second tray makes an angle of less than 90° with said first tray whereby yarn packages on said second tray are deposited onto said first tray.

4. An assembly as recited in claim 1 wherein said means for supporting said tray means for movement comprises track means disposed in a horizontal plane and generally perpendicular to an extension of spindle when in said horizontal position.

5. An assembly as recited in claim 4 wherein said supporting means further comprises roller means and sleeve means connected to said tray means for cooperation with said track means.

6. An assembly as recited in claim 5 further comprising powered means for moving said tray means with respect to said track means, said powered means including a screw drive means for cooperation with sleeve means mounted on said tray means.

7. An assembly as recited in claim 1 wherein said yarn package moving and compressing means includes a powered compressing member, said compressing member including a hoop member for operatively abutting a yarn package while allowing access to the interior thereof.

8. An assembly as recited in claim 1 further comprising means for shifting said tray means in a horizontal plane in line with axis of rotation of said carrier when said spindles are horizontally disposed relative to said package carriers.

9. An assembly as recited in claim 1 wherein said means for holding a yarn package carrier onto said first frame comprises a plurality of linearly movable latch projections movable from a first position wherein no engagement with cooperating surfaces on a package carrier is made to a second position wherein engagement with cooperating surfaces on a package carrier is effected.

10. An assembly as recited in claim 9 further comprising power means for moving said latch projections.

11. An assembly as recited in claim 10 further comprising a screw-threaded rod associated with each of said latching projections, and means for mounting said projections on a rod to allow relative rotary movement therebetween, and wherein said screw-threaded rods are connected to said power means and are adapted to be rotated thereby.

12. An assembly as recited in claim 1 further comprising power means for rotating said holding means and a carrier attached thereto relative to said axis of rotation.

13. An assembly for loading a plurality of yarn packages onto spindles of a yarn package carrier without the necessity of using a spindle extension, said assembly comprising:

a. movable mounting means for mounting a yarn package carrier so that the spindles of said carrier may be moved from a vertically disposed position to a horizontal position, b. means for holding a yarn package carrier onto said movable mounting means c. generally horizontally disposed loading tray means for receipt of a plurality of yarn packages for subsequent loading onto a spindle of a yarn package carrier, d. means associated with said tray means for moving yarn packages from said tray means onto a horizontally disposed spindle of a yarn package carrier mounted on said mounting means, and for compressing said packages onto said spindle, and e. means for allowing positioning of a horizontally disposed spindle of a yarn package carrier mounted on said movable mounting means and said horizontally disposed loading tray so that said tray and said spindle are in alignment so that yarn packages from said tray may be disposed onto said spindle by said package moving and compressing means.

14. A method of loading a plurality of yarn packages onto a yarn package carrier having a plurality of spindles extending therefrom, comprising the steps of:

a. loading tray means with yarn packages, b. moving said yarn package carrier from a vertical position to a horizontal position, c. positioning said tray means for cooperation with said package carrier, d. compressing said yarn packages from said tray means onto a horizontally disposed spindle of said package carrier, and e. locking said yarn packages onto said spindle while said spindle is still horizontally disposed.

15. A method as recited in claim 14 comprising the further steps of repeatedly repositioning said tray means for cooperation with a spindle of said package carrier, reloading said tray means, compressing yarn packages from said tray means onto said spindle, and locking said packages from said spindle until all the spindles of said carrier have yarn packages locked thereon.

16. A method as recited in claim 15 comprising the further steps of moving said package carrier back to its vertical position after it is loaded, transporting said spindle carrier to a dyeing vat or the like, and dyeing the packages on said spindle.

* * * * *